United States Patent [19]

Sackmann et al.

[11] Patent Number: 4,532,388

[45] Date of Patent: Jul. 30, 1985

[54] ELONGATE RESILIENT SECTION AT THE CLOSURE EDGE OF A CLOSURE

[75] Inventors: Karl H. Sackmann; Christoph Anselment, both of Waldkirch, Fed. Rep. of Germany

[73] Assignee: Erwin Sick GmbH Optik-Elektronik, Fed. Rep. of Germany

[21] Appl. No.: 525,538

[22] Filed: Aug. 23, 1983

[30] Foreign Application Priority Data

Aug. 31, 1982 [DE] Fed. Rep. of Germany ..... 3232365
Apr. 5, 1983 [DE] Fed. Rep. of Germany ..... 3312223

[51] Int. Cl.[3] ..... H01H 3/16
[52] U.S. Cl. ..... 200/61.43; 200/61.62
[58] Field of Search ..... 200/61.43, 86, 61.42, 200/61.62, 61.71

[56] References Cited

U.S. PATENT DOCUMENTS 3,622,723 11/1971 Fischel ..... 200/86 R
3,812,313 5/1974 Wolf et al. ..... 200/86 R
3,830,018 8/1974 Arai et al. ..... 200/61.43 X
4,051,336 9/1977 Miller ..... 200/61.43
4,115,952 9/1978 French ..... 200/61.43 X

FOREIGN PATENT DOCUMENTS 2719438 11/1978 Fed. Rep. of Germany .

*Primary Examiner*—Patrick R. Salce
*Assistant Examiner*—Morris Ginsburg
*Attorney, Agent, or Firm*—Townsend and Townsend

[57] ABSTRACT

An elongate resilient section at the closure edge of a closure movable to close an opening contains at least one electrical switching strip 11 which is arranged in an associated hollow cavity (13, 14; 113) close to the elongate securing block (28; 120) used to secure the resilient section to the closure edge. The resilient section is so constructed that the electrical switching strip or strips (11; 11, 12) is actuated not only by compressive forces acting in the direction of closure but also by forces acting sideways on the resilient section.

12 Claims, 8 Drawing Figures

ELONGATE RESILIENT SECTION AT THE CLOSURE EDGE OF A CLOSURE

The invention relates to an elongate resilient section at the closure edge of a closure such as a swinging door, a sliding door, a roller door or a container lid, movable to close an opening, wherein the section has at least one longitudinally extending, elongate hollow chamber in which a resilient electrical switching strip with two insulated and resiliently spaced apart contact bands is arranged, wherein the contact bands come into electrical contact on the exertion of pressure and thereby generate a drive-stop or drive-reverse signal, and wherein an elongate, undercut, securing block is provided in the region of the closure edge and engages in a rail of the closure edge.

In a previously known resilient section of this kind, described in German laying open print 27 19 438, the pair of contact bands is attached to a resilient insulating body and the assembly is subsequently drawn into a hollow cavity of the section. The disadvantage of this arrangement is the fact that the pair of contact bands are extensively exposed to the outside environment until they are housed in the hollow cavity of the resilient section; they can thus be easily damaged both during transport to the place of use and also as they are drawn into the section. Moreover, the previously known resilient section does not ensure that trouble free contact is established between the pair of contact bands even during lateral loading of the section. A resilient section with a pair of contact bands tensioned close to their point of attachment is also known (U.S. Pat. No. 4,115,952). In this arrangement the pair of contact bands is likewise drawn into the resilient section which is attached to a door so that the same danger of damage exists as with the safety device of German laying open print 27 19 438.

It is a further disadvantage of the previously known resilient section (U.S. Pat. No. 4,115,952) that the webs of the section which are arranged in a V-shape terminate at their outer ends at a semicircular arcuate element. Neither a transverse connection, nor a rib provided thereon are present at the ends of the webs which lie furthest apart. If the semicircular arcuate element is deflected in the direction of the pair of contact bands by contact with an obstacle the V-shaped webs will initially be pressed outwardly and switching does not immediately take place. Switching is only possible with the known resilient section at relatively high switching forces and with very long switching paths, i.e. after substantial deformation of the resilient section. A further disadvantage of the known arrangement lies in the fact that the individual bands of the pair of contact bands consist of solid unperforated metal. This means that the switching force that is required, and which is in any event large, is made even higher.

The principal object underlying the present invention is to provide an elongate resilient section of the initially named kind in which the pair of contact bands is housed in such a way that it is completely protected against external effects, and can thus be introduced into hollow cavities of the resilient section without the danger of damage occurring.

In order to satisfy this object the invention envisages that the switching strip is constructed as an extruded synthetic hollow section in which the pair of contact bands is arranged and is secured with its flat base at least close to the securing block or to said rail; and that the synthetic hollow section has a curved region remote from the base which engages with at least one web which, on contact with an obstacle, is displaced in a direction corresponding to pressing together of the pair of contact bands.

Thus, in accordance with the invention, the pair of contact bands is housed in a synthetic hollow section in which it is completely protected against external effects before it is introduced into the resilient section. In this manner damage to the sensitive pair of contact bands can no longer occur when the synthetic hollow section is introduced into the resilient section which is to be attached to the edge of the door. Furthermore, the construction of the invention ensures that even with laterally directed blows against the resilient section the forces are deflected so that they act substantially at right angles to the pair of contact bands, which are preferably arranged parallel to the plane of attachment, and thus that reliable contact is established in every case. As a result of the arrangement of the synthetic hollow section near the point of attachment it is further ensured that actuation of the pair of contact bands cannot occur simply as a result of normal contact of the resilient section with the edge of the opening during the closing process.

It is particularly advantageous if a rib extends from the curved region of the hollow section towards the pair of contact bands and terminates at a minimal distance from the pair of contact bands. In this way it is ensured that the pair of contact bands will always be acted on substantially at right angles to its plane even with actuating forces which act approximately sideways on the synthetic hollow section.

It is particularly advantageous if the contact band which lies loosely on the flat base is continuous and does not have parts projecting beyond its two flat surfaces, and if the second contact band which lies loosely on the first has transverse or inclined slots extending parallel to one another with webs therebetween and carries fixedly attached insulating strips at its side facing the continuous contact band in the region of its continuous edge regions.

The contact band provided with the inclined slots should also have a central longitudinal web which, if provided, faces the rib that is present and is spaced a minimal distance therefrom.

The inclined slots are expediently made somewhat broader than the webs which lie therebetween whereas the inclined webs and the longitudinal webs should in general be of substantial equal width.

As a result of the fact that the contact band facing the switching force that is acting is provided with apertures the force required to produce switching is substantially reduced. As the insulating strips are provided on the contact band which is provided with the apertures short circuits cannot arise as a result of the minor lateral relative displacements of the two contact bands that are possible. In order to avoid short circuits between the contact bands on bending the synthetic hollow section of the invention the insulating strips are provided on the contact band provided with the apertures. It is important that the two contact bands lie loosely on one another so that they can move relative to one another during the switching process, however a transverse displacement is only permissable to a restricted degree because of the danger of a short circuit.

Trouble free transmission of the switching force to the pair of contact bands is ensured as a result of the central longitudinal web. Moreover, both a low switching force and also operational reliability down to −30° C. are ensured.

Furthermore it is expedient if the synthetic hollow section is arranged in an intermediate section which is in turn housed in a hollow cavity of the resilient section. As a result of this embodiment the switching strip is subjected to even more careful treatment as it is introduced into the resilient section, because the synthetic hollow section is first attached to the intermediate section before the latter is drawn into the resilient section.

The intermediate section with the synthetic hollow section is advantageously centrally arranged in the resilient section.

Furthermore, it is advantageous if the intermediate section is open to one side and indeed preferably in the direction away from the closure edge, i.e. towards the fixed edge of the opening to be closed.

In accordance with a first practical embodiment the synthetic hollow section projects beyond the intermediate section and terminates at a small distance from a transverse web of the resilient section.

In accordance with a further embodiment the construction should be such that the synthetic hollow section is arranged sunk in the intermediate section, and such that a switching rib extends from a transverse web to the synthetic hollow section, and either terminates shortly in front of this synthetic hollow section or touches it.

In one embodiment the intermediate section is arranged on a damping web.

For trouble free actuation of the switching strip on the exertion of pressure from all directions it is expedient if the damping web is separated from the elongate securing block by a hollow cavity.

A further embodiment is characterised in that the transverse web can be loaded in the direction of the synthetic hollow section by actuating webs which converge in V-manner towards the transverse web from a further transverse web which is preferably flat.

Finally, it is expedient if the further transverse web can be acted on by a longitudinal web adjacent the edge of the resilient section remote from the securing block.

Thus, in accordance with the invention, the ends of the V-shaped webs which tend to move apart from one another do not terminate at an outwardly curved transverse web but instead at a straight line or flat transverse web. The said longitudinal web expediently acts centrally on this flat transverse web in order to transmit the switching force from the outside. This arrangement is of considerable significance for the attainment of switching at low switching forces and with short switching paths. The switching path can in this way be reduced to approximately 4 to 6 mm. After switching has occured the resilient section is still able to undergo considerable further deformation, i.e. the so-called rest deformation is very high. This is important for the overrun which is encountered with doors, gates etc., i.e. the overrun which occurs before the motor can be stopped or reversed.

In order to be able to change the sensitivity of the switching strip a particularly preferred embodiment of the invention envisages that the switching path between the switching rib and/or the transverse web and the synthetic hollow section can be varied by inserting intermediate pieces between the synthetic hollow section and the intermediate section.

A particularly good response of the resilient section to forces from the most diverse directions is ensured if two synthetic hollow sections are arranged on opposite sides of the central longitudinal plane.

With this arrangement the two synthetic hollow sections should preferably be arranged at the securing block or at the rail of the closure edge in order to provide good protection for the switching strips.

A first practical embodiment with two switching strips arranged parallel to one another is characterised in that the synthetic hollow sections are housed in elongate hollow chambers provided in projections of the securing block, and in that the projections merge at the side remote from the securing block into pressure transmitting connecting webs.

In a further embodiment with two switching strips it is arranged that the hollow cavities for the synthetic hollow sections are formed by lateral grooves in the securing block, with the rail at the closure edge (which is fixedly connected to the synthetic hollow sections) also engaging in these lateral grooves.

In all arrangements supporting webs which are of thinner construction than the connecting webs can extend at the sides of the resilient section alongside the connecting webs in such a way that the essential force transmission takes place via the connecting webs.

In order to ensure adequate elasticity of the resilient section, so that a switching process is not initiated even for the most trivial contact with the resilient section a particularly preferred embodiment envisages that at least one and preferably two hollow cavities are provided one behind the other at the side of the resilient section remote from the attachment surface.

The invention will now be described in the following by way of example only and with reference to the drawings as follows:

FIG. 1 is a section at right angles to the longitudinal axis of a switching strip which is particularly suitable for use in the resilient section of the present invention.

FIG. *a* is a plan view of the contact band 15 of the switching strip of FIG. 1 as seen from beneath.

Figure 1:
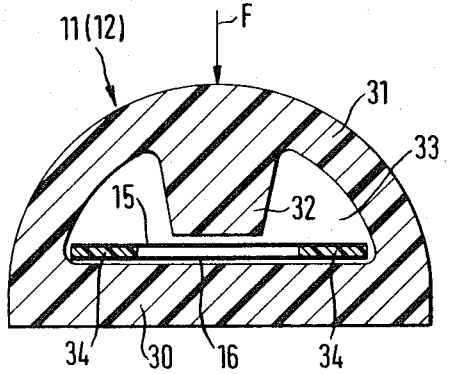

As seen in FIG. 1 the switching strip 11 used with the resilient section of the invention consists of an extruded synthetic hollow section, in particular of polyvinyl chloride, with a substantial semicircular cross-section. The cross-section has a flat base 30 and a semicircular region 31 of curved shape which surround an elongate hollow cavity 33 provided in the interior of the synthetic section. A pair of contact bands consisting of the contact bands 15, 16 lies flat at the base 30 of the semicircular cross-section.

Figure 1A:
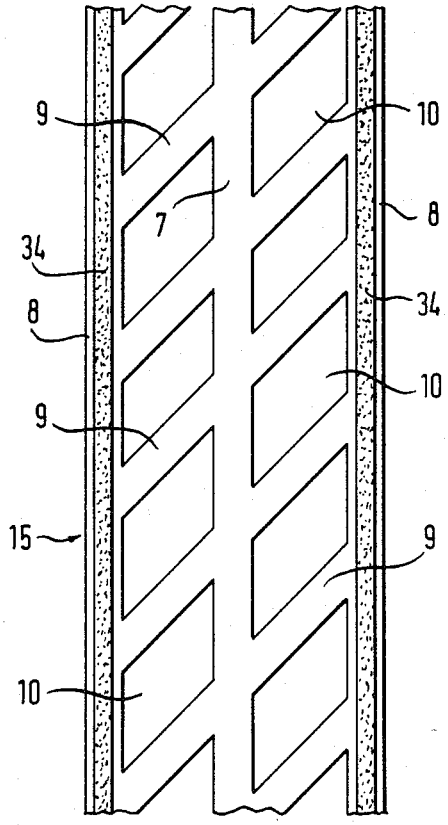

The contact bands 15, 16 consist of thin spring steel and, in a typical embodiment, have a width of substantial 5 mm and a thickness of substantially 0.05 mm. Whereas the contact band 16 adjacent the flat base 30 (which is shown as a straight line in the section of FIG. 1) is continuous, i.e. does not have any apertures, the upper contact band 15 as seen in FIG. 1 should be provided, as shown in FIG. 1*a*, with a plurality of equally sized inclined slots 10 which are arranged at equal intervals and between which inclined webs 9 remain. Continuous longitudinal webs remain at the two side edges and insulating strips 34 of synthetic material are attached to these continuous edge regions as a solid non-separable layer. The insulating strips 34 face the contact band 16, but are however not connected therewith. On the contrary they lie loosely on the contact band 16 which in turn lies loosely on the base 30 of the synthetic hollow section 11.

The contact band 15 also preferably exhibits the central longitudinal web 7 illustrated in FIG. 1*a*.

A rib 32 extends from the arcuate region 31 into the hollow cavity 33 towards the pair of contact bands 15, 16 and terminates at a minimal distance above the upper contact band 15, and indeed in the vicinity of the central longitudinal web 7 in the upper contact band 15. If a pressure is now exerted in the direction of the arrow F in FIG. 1 on the switching strip 11 of resilient material, which is supported at the base 30, the curved region 31 deforms in such a way that the rib 32 contacts the upper contact band 15 and finally presses this resiliently downwardly against the lower contact band 16 so that an electrical connection is temporarily created between the contact bands 15, 16 but is broken again when the force F is removed.

The contact bands 15, 16 with the insulating strips 34 arranged therebetween must lie loosely in the synthetic hollow section over the desired temperature range from −30° C. to +80° C. The play in all directions should amount to a minimum of 0.2 mm when the switching strip is at rest, i.e. when it is not deformed by any external forces. The contact bands should not adhere to one another during extrusion. They must lie on top of one another so that they are easily displaceable and indeed even after extrusion.

The contact bands must therefore be loosely arranged within the synthetic hollow section and also displaceable relative to one another within limits. For this reason it is important that the contact bands 15, 16 are located in the synthetic hollow section. In this way it is possible to provide the required freedom of movement to avoid the undesired establishment of contact, for example due to stresses and strains, and it is also possible to restrict the relative displacements that can take place so that the relatively loose arrangement does not itself lead to undesired contact between the contact bands.

The displaceability of the contact bands 15, 16 is restricted so that the edges of the contact band 16 cannot enter into the space between the insulation strips 34, because this would lead to a short circuit.

On compressing the contact bands 15, 16 the insulating strips or spacers 34 should not deform. They should therefore not consist of foam rubber but rather preferably of a non-yielding synthetic material.

Figure 3:
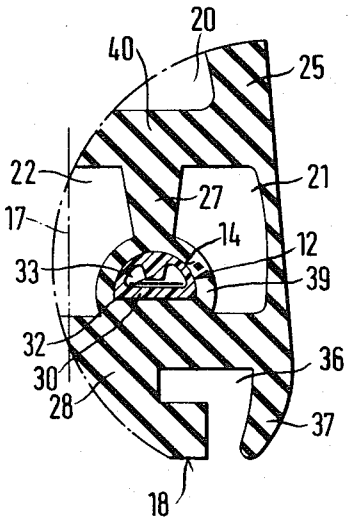
FIG. 3 is the section III from FIG. 2 to an enlarged scale.
Figure 2:
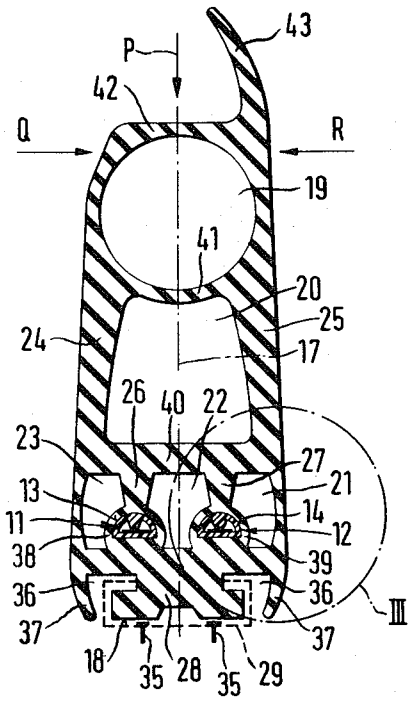
FIG. 2 is a section extending at right angles to the longitudinal axis of a first embodiment of a resilient section in accordance with the invention and having two switching strips which extend parallel to one another.

As seen in FIGS. 2 and 3 the resilient section of the invention has a securing block 28 of essentially inverse C-shape with a securing surface 18 which is intended to be attached to the closure edge of a door or the like. The T-section of the securing block 28 serves to accommodate a rigid C-section, which is only shown in broken lines in FIG. 2 but is later illustrated in detail in FIG. 4, and which is secured by means of screws 35 to the closure edge of the door or roller door. The elongate resilient section of the invention is either pushed in the longitudinal direction into the rigid C-section or, as will later be described in more detail, can be inserted into the C-section through the open side. The hollow cavity 36 intended to accommodate the rigid C-section 29 is covered over at the outside by sealing lips 37 which also protect the C-section 29 against external effects.

As a result of this construction the resilient section can be snapped into the rigid C-section 29 without difficulty. To do this the right hand (for example) lower nose of the securing block 28 is first introduced into the C-section through the open side so that it is positioned beneath the inwardly turned flange of the right hand limb of the section. The resilient section 28 is then rotated by a pivoting force in the counter-clockwise direction which results in the left hand nose snapping into position behind the turned-over lip of the left hand limb of the C-section. This process can be facilitated if a hollow cavity, which may for example be oval in shape, is provided in the securing block between the two undercuts into which the inwardly turned flanges of the C-section 29 engage. Elongate cavities 13, 14 are formed in projections 38, 39 arranged on both sides of the central longitudinal plane 17 at the side of the securing block remote from the securing surface 18. A respective switching strip 11, 12, as illustrated in FIG. 1, is housed in each of these elongate hollow cavities 13, 14 respectively. The projections 38, 39 merge at the side remote from the securing surface 18 into pressure transmitting connecting webs 26, 27 which terminate at a transverse web 40, with the transverse web 40 merging at its ends into support webs 24, 25.

The support webs 24, 25 extend in the direction of the securing surface 18 beyond the transverse web 40 to the sealing lips 37 where they extend parallel to the pressure transmitting connecting webs 26, 27 but are thinner than the latter so that the important force trransmitting path passes via the connecting webs 26, 27 to the switching strips 11, 12 arranged in the hollow cavities 13, 14.

At the side of the section remote from the transverse web 40 the support webs 24, 25 are connected together by a further transverse web 41 which, together with the outer extensions of the support webs 24, 25 and a terminal transverse web 42 surrounds a hollow cylindrical chamber 19. A further elongate sealing lip 43 is provided at the end of the support web 25 remote from the securing surface 18.

As a result of the described construction an elongate hollow chamber 20 is formed between the support webs 24, 25 and the transverse webs 40, 41 and further elongate hollow chambers 21, 22, 23 are formed alongside and between the connecting webs 26, 27. These hollow chambers, in conjunction with the resilient nature of the material ensure the desired deformability of the resilient section.

The manner of operation of the described section is as follows:

If a force is exerted on the resilient section in the direction of the arrow P in FIG. 2, which would for example be the case if an article were to become trapped during the closing movement then the support webs 24, 25 in the region of the hollow chambers 19 and 20 will first of all deflect resiliently sideways and the switching strips 11,12 will not initially respond. After a predetermined force threshold has been exceeded the force transmitted to the connecting webs 26, 27 is sufficient to produce contact of the contact bands 15, 16 via the rib 32 so that an alarm signal, a stop signal and/or a reverse signal can be initiated.

If a force acts in the direction of the arrow Q on the resilient section then there initially occurs only a deformation in the relatively soft elastic region of the hollow cavities 19, 20 prior to the switching strip 12 being caused to respond via the connecting web 27 once a specific force has been exceeded.. In this case only a tension is exerted on the further connecting web 26 so that the switching strip 11 does not respond. However, if the two switching strips 11,12 are connected electrically in parallel then the response of the switching strip 11 is sufficient to initiate an electrical contact signal. It is thus important that the two switching strips 11, 12 have a distance from the central longitudinal plane 17 such that on exerting a lateral force Q a corresponding pivotal or longitudinal movement occurs at the connecting webs 26, 27.

If a lateral force occurs in the direction of the arrow R the reverse procedure occurs, i.e. the switching strip 11 is caused to respond via the connecting web 26 whereas the connecting web 27 is loaded in tension.

Figure 4:
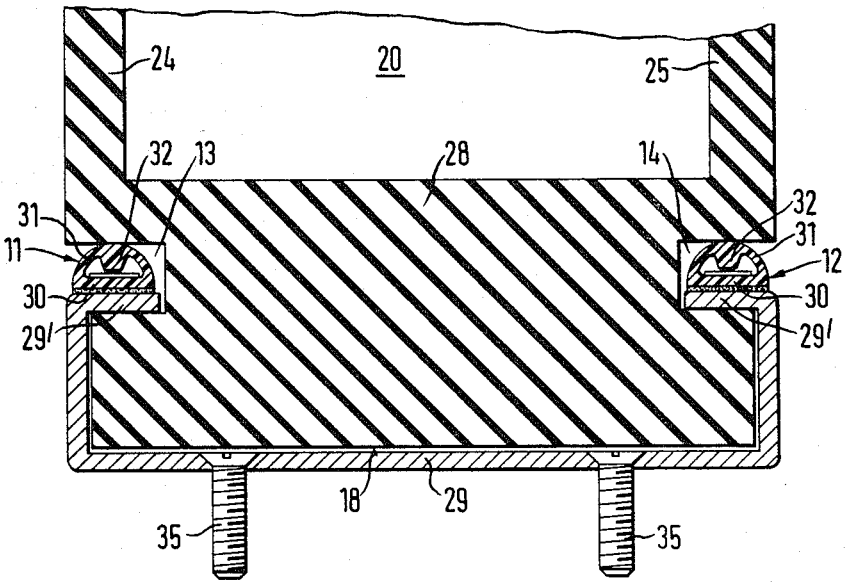
FIG. 4 is section extending at right angles to the longitudinal axis of a further embodiment of the resilient section of the invention.

In the embodiment of FIG. 4 the same reference numerals designate parts which have counterparts in FIGS. 2 and 3. As seen in FIG. 4 the switching strips 11, 12 are housed in lateral, outwardly open grooves 13, 14 in such a way that their curved regions 31 touch the side surfaces of the U-shaped grooves remote from the securing surface 18. The flat bases 30 of the switching strips 11, 12 are secured to the inwardly turned end flanges 29' of the rigid C-section 29. They are preferably secured by means of an adhesive.

The C-section 29 is secured by means of screws 35 to the closure edge (not illustrated) of a door or roller door. The C-section clamps the securing block 28 of the resilient section of the invention in such a way that it is fixed against the forces P, Q and R indicated in FIG. 2.

As seen in FIG. 4 the support webs 24, 25 which laterally delimit the hollow chamber 20 terminate directly at the securing block 28. The grooves 13, 14 can only be arranged beneath the point at which the support webs 24, 25 terminate by an amount such that the elastic deformation required to actuate the switching strips 11, 12 is obtained under the effects of the forces P, Q and R.

The embodiment of FIG. 4 offers the advantage that the assembly of the switching strips 11, 12 is possible in an extremely simple manner and that in the event of damage the switching strips can also be exchanged at any time.

As a result of the described construction the response behaviour is thus largely independent of the direction from which pressure is exerted on the surface of the elongate section. Moreover, it is straightforwardly possible to arrange the switching strips on the base of the resilient section in such a way that they are protected from the outside so that mechanical damage to the switching strips themselves can be largely prevented and so that a defined switching path is present.

This particularly applies to the embodiment of FIG. 4 where the switching strip is completely covered from at least three sides. The elastic deformation, for example during run-on of the closure edge takes place substantially only in the front region of the resilient section near to the closure surface so that the apparatus does not respond as soon as the section touches the closure surface.

The resilient section and the switching strips contained therein function largely independently of their position. Reliable pressure transmission to the switching contacts is ensured and only a relatively low switching force is required to actuate the actual switching contacts.

The resilient section of the invention can also be used as a protective device with dangerous machinery, for example with presses, in order to form a stop signal or a reverse signal in the event that the hand of the operator becomes trapped.

Figure 5:
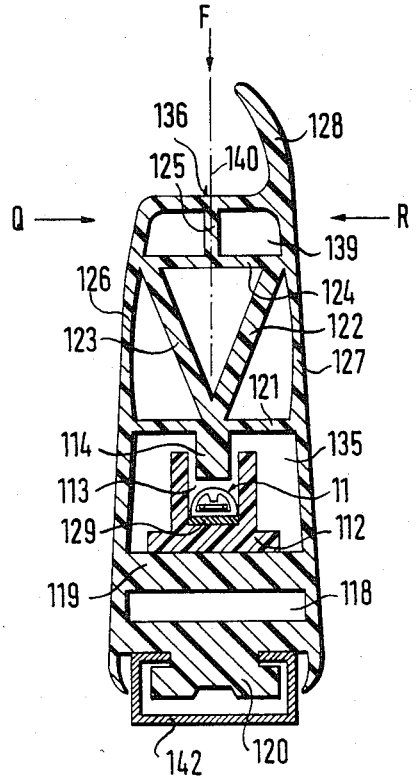
FIG. 5 is a cross-section through a resilient section of a further embodiment in accordance with the invention.

As seen in FIG. 5 the switching strip 11 is centrally arranged in an intermediate section 112 which has a substantially rectangular cross-section with lateral projections in the lower region in order to increase the support surface. At the side rembte from the securing block 120 the intermediate section 112 has a U-shaped groove 113, the width of which corresponds to the width of the switching strip 11. The depth of the groove 113 is however considerably greater than the height of the switching strip 11. In this manner the switching strip 11 is arranged sunk reliably inside the groove 113. The switching strip is adhered to the base of the groove. If required an intermediate spacer 129 can be inserted between the switching strip and the base of the groove 113 which makes it possible to adjust the vertical position of the switching strip 11 within the groove 113.

The intermediate section 112 is arranged on a transverse web 119 of the resilient section shown in FIG. 5 and the transverse web 119 is separated from the securing block 120 by a hollow chamber 118. The securing block 120 is inserted into a metal section or rail 142 with an opening along one side This arrangement of the intermediate section 112 ensures a certain degree of damping in the event of actuation which extensively precludes undesired damage to the switching strip 11.

A switching rib 114, which is attached to a relatively thin transverse web 121 of the resilient section, and which has a small distance from the switching strip, extends from above the groove 113 into this groove.

Two actuating web 122, 123 extend divergently in a V-like manner from the base of the switching rib 114, i.e. from the point at which the switching rib 114 merges with the transverse web 121, away from the securing block 120 and terminate in the region of the sidewalls of the resilient section. At this point a further transverse web 124 is provided which is loaded centrally by a longitudinal web 125 which adjoins the terminal wall 136 of the resilient section. The resilient section is completely closed from the outside by sidewalls, with the sidewalls being formed in the region of the actuating webs 122, 123 by thin deformable webs 126, 127.

In the region of the terminal wall 136 a sealing lip 128 extends outwardly from the sidewall 127 of the resilient section. The sealing lip 128 has a shallow convex curvature which extends approximately up to the central plane of the resilient section. The sealing lip 128 terminates still at a significant angle to the lateral arrows R and Q i.e. obliquely relative to the central longitudinal plane.

The metal section 142 is for example secured to the closure edge of a roller door.

The manner of operation of this resilient section is as follows:

If a vertical force acts in the direction of the arrow F the sealing lip 128 will be bent around towards the central longitudinal plane 140 of the resilient section. As a result the force will now be transmitted substantially to the central longitudinal web 125 of the upper hollow chamber 139. In this way the longitudinal web 125 will be moved in the direction of the metal section 142. As a result the transverse web 124 will be downwardly bent in the direction of the metal section 142 and thus draws the actuating webs 122, 123, which are arranged in V-like manner to one another, towards the central longitudinal plane 140 in the area where they are spaced apart. In this manner the switching rib 114 is moved downwardly so that it acts on the switching strip 11 and initiates the desired electrical switching process.

The movements which occur are similar if the force acts in the lateral directions Q or R. In this case either the actuating web 122 or the actuating web 123 will be moved towards the central longitudinal plane 140 which will then likewise result in a movement of the switching rib 114 in the direction of the switching strip 11.

Thus a switching process will be reliably initiated via the switching strip 11 substantially independently of the direction from which the force acts. Thus a sensitive initiation of the switching process is ensured with only one switching strip 11. The relatively thin deformable webs 126, 127 do not hinder the movement of the actuating webs 122, 123 because they are relatively thin-walled and can thus simply bow outwardly.

The entire switching force F is not directly transmitted downwardly but is instead converted by the longitudinal web 125 into a lever movement of the actuating webs 122, 123 which are arranged in V-like manner relative to one another. This considerably reduces the switching force.

The switching strip 11 admittedly lies at a certain distance from the securing block 120; it nevertheless lies sufficiently deep in the resilient section to ensure adequate protection.

The hollow cavity 118 forms an additional damping zone which is also dependent on the height of the securing block 120.

Figure 6:
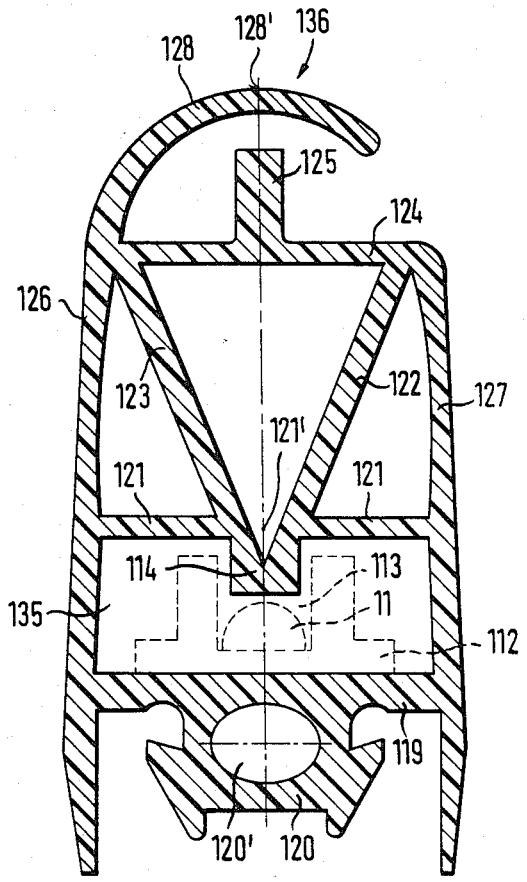
FIG. 6 is an analogous cross-section of a further embodiment.

In the embodiment of FIG. 6, in which the same reference numerals are used to designate parts having counter-parts in FIG. 5, the hollow cavity 118 is omitted, i.e. the intermediate section 112 lies directly on the securing block 120. The resilient section is correspondingly more compact. An axial hollow passage 120' in the securing block increases the elasticity of the securing block 120 and facilitates the insertion of the securing block into a metal section or retaining rail.

The transverse web 121 is interrupted in the middle by a V-notch 121' so that the actuating webs 122, 123 extend practically into the switching rib 114. This reduces the switching force.

A further reduction of the switching force is obtained by the omission of the hollow chamber 139 of FIG. 5 and by allowing the longitudinal web 125 to project freely from the transverse web 124. The free end of the longitudinal web 125 is simply covered over by the arcuate sealing lip 128 which is spaced therefrom. The apex 128' of the sealing lip 128 lies in the FIG. 6 embodiment approximately in the central longitudinal plane and the sealing lip 128 itself extends significantly beyond the central longitudinal plane.

The intermediate section 112 is housed in a hollow cavity 135 which is bounded by the transverse webs 119 and 121 and also by the sidewalls of the hollow section. The intermediate section 112 is merely fixedly attached to the transverse web 119 and is otherwise spaced by a considerable distance from the walls of the hollow cavity 135.

Figure 7:
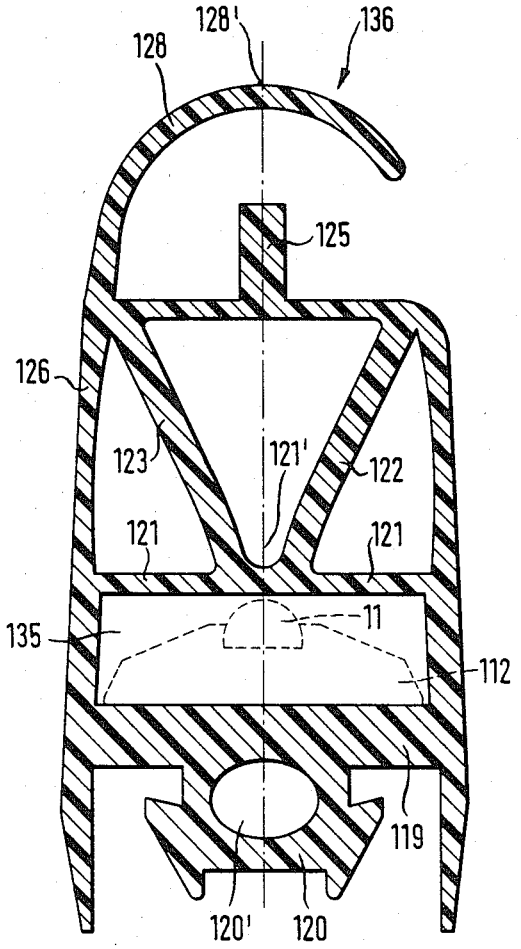
FIG. 7 is a modification of the embodiment of FIG. 6.

The embodiment of FIG. 7 corresponds largely with the embodiment of FIG. 6. However in this embodiment the switching rib 114 is omitted. In place of this the switching strip 11 projects significantly beyond the intermediate section 112 in the direction away from the securing block and terminates at a small distance from the transverse web 121. In this manner the switching strip 11 can be acted on directly by the actuating webs 122, 123 via the transverse web 121.

We claim:

1. A composite elongate resilient section for mounting in a rail at the edge of a closure member movable to close an opening, comprising:

first and second longitudinally extending elongate hollow cavities in said elongate resilient section on opposite sides of a central longitudinal plane thereof, and said elongate resilient section further having an elgonate, undercut, securing block adapted to engage said rail;

a resilient switching strip disposed in each said elongate hollow cavity, each said resilient strip comprising first and second confronting resilient contact bands, a spacer disposed between said first and second contact bands along each longitudinal edge therof to maintain said contact bands in spaced apart relationship, and an extruded synthetic hollow section surrounding said contact bands and said spacers, said extruded synthetic hollow section having a flat base by which it is secured to the inside of the respective one of said first and second hollow cavities adjacent to said securing block and an outwardly curving wall opposing said flat base; and first and second actuating webs in said elongate resilient section, each said web sufficiently close to one said curving wall, whereby upon distortion of said elongate resilient section at least one of said webs is urged toward said curving wall, causing compression of said hollow section and contact between said first and second contact bands disposed therein to generate a signal.

2. A composite elongate resilient section in accordance with claim 1 further comprising an elongate rib extending from each said outwardly curving wall inward toward said first and second contact bands.

3. A composite elongate resilient section in accordance with claim 1 in which said first contact band rests loosely on said flat base and is flat and continuous, said second contact band rests loosely above said first contact band and has transverse parallel slots with intervening webs therebetween, and said spacers are insulating strips affixed to said second contact band on the side facing said first contact band.

4. A composite elongate resilient section in accordance with claim 3 further comprising a central longitudinal web in said second contact band and an elongate rib extending from each said outwardly curving wall inward toward said central longitudinal web.

5. A composite elongate resilient section in accordance with claim 3 in which slots are wider than said intervening webs.

6. A composite elongate resilient section in accordance with claim 3 further comprising a central longitudinal web in said second contact band, said central longitudinal web and said intervening webs being of substantially the same width.

7. A composite elongate resilient section in accordance with claim 1 in which said longitudinally extending elongate hollow cavities are chambers encircling said resilient switching strips and extending from said securing block, and each said actuating web is joined to the exterior of one said chamber on the side away from said securing block.

8. A composite elongate resilient section in accordance with claim 1 in which said elongate resilient section is comprised of support webs of lesser thickness than said actuating webs.

9. A composite elongate resilient section for mounting in a rail at the edge of a closure member movable to close an opening, comprising:

an external elongate resilient section having at least one hollow cavity extending longitudinally;

an intermediate resilient section disposed in each said hollow cavity, defining an elongate channel open at one side; and an elongate resilient switching strip disposed in said intermediate resilient section, comprising (a) an elongate hollow chamber defined by a curved wall and a flat base wall joined thereto, (b) first and second elongate, confronting, resilient and spaced apart contact bands disposed within said hollow chamber, and (c) spacers disposed between said contact bands along each longitudinal edge thereof to maintain said contact bands in spaced apart relationship; and an elongate actuating web inside said external elongate resilient section, projecting into the open side of said channel toward said elongate resilient switching strip, whereby upon distortion of said external elongate resilient section said web is urged against said curved wall, compressing said elongate hollow chamber and causing contact between said first and second contact bands disposed therein to generate a signal.

10. A composite elongate resilient section in accordance with claim 9 further comprising a spacer disposed between said intermediate resilient section and said flat base wall of said elongate resilient switching strip to permit adjustment of the width of the gap between said actuating web and said elongate resilient switching strip.

11. A composite elongate resilient section in accordance with claim 9 further comprising at least one additional hollow cavity in said external elongate resilient section positioned on the side of said hollow cavity containing said intermediate resilient sections.

12. A compostie elongate resilient section for mounting in a rail at the edge of a closure member movable to close an opening, comprising:

an external resilient section having at least one hollow cavity extending longitudinally; and an elongate resilient switching strip disposed in said hollow cavity and having elongate, confronting, resilient and spaced apart contact bands which contact each other upon deformation of said elongate resilient switching strip to generate a signal;

said external elongate resilient section further comprising:

(a) a first transverse web positioned adjacent said elongate resilient switching strip and having an actuating region confronting said elongate resilient switching strip, (b) first and second actuating webs joined in V-shaped manner opening away from said rail when said composite elongate resilient section is mounted thereon, the closed end of said V joined to said first transverse web at said actuating region;

(c) a second transverse web interconnecting said first and second actuating webs at the open end of said V;

(d) a longitudinal web joined to said second transverse web at a central region thereof; and (e) first and second relatively flexible side walls connecting said actuating webs at the open end of said V to said first transverse web.

* * * * *